United States Patent [19]

Piber et al.

[11] Patent Number: 4,813,136

[45] Date of Patent: Mar. 21, 1989

[54] DRY SHAVER

[75] Inventors: Herbert Piber, Ferlach; Günther Schmid, Unterferlach; Johann Schuhfleck, Ferlach, all of Austria

[73] Assignee: U.S. Philips Corporation, New York, N.Y.

[21] Appl. No.: 188,745

[22] Filed: Apr. 29, 1988

Related U.S. Application Data

[63] Continuation of Ser. No. 882,317, Jul. 7, 1986, abandoned.

[30] Foreign Application Priority Data

Jul. 9, 1985 [AT] Austria ..... 2030/85

[51] Int. Cl.[4] ..... B26B 19/02

[52] U.S. Cl. ..... 30/43.92; 30/45; 310/50

[58] Field of Search ..... 30/42, 43, 43.7, 43.8, 30/43.9, 43.91, 43.92, 44, 45; 310/37, 50, 89

[56] References Cited

U.S. PATENT DOCUMENTS

| | | | |
|---|---|---|---|
| 3,772,779 | 11/1973 | Douglass et al. | 30/45 |
| 4,030,573 | 6/1977 | Buzzi et al. | 30/45 X |
| 4,167,060 | 9/1979 | Sakamoto | 30/43.92 |
| 4,184,088 | 1/1980 | Richert | 30/43.92 X |
| 4,240,200 | 12/1980 | Bukoschek | 30/43.92 |
| 4,420,702 | 12/1983 | Mixner | 30/45 X |
| 4,631,825 | 12/1986 | Kuriyama et al. | 30/43.92 |

FOREIGN PATENT DOCUMENTS

| | | | |
|---|---|---|---|
| 2058643 | 4/1981 | United Kingdom | 30/45 |

*Primary Examiner*—Frank T. Yost
*Assistant Examiner*—Michael D. Folkerts
*Attorney, Agent, or Firm*—Ernestine C. Bartlett

[57] ABSTRACT

A dry shaver comprises a basic unit housing together with a shaver head having a longitudinally extending upper blade and a reciprocatorily drivable longitudinally extending lower blade acting in conjunction therewith. A swinging bridge is secured in the basic unit housing and has a reciprocatory output part for driving the lower blade and a stationary base part provided with an aperture. An electric motor having an essentially-cylindrical housing has one end of the motor housing connected to the stationary base part of the swinging bridge, the drive shaft of the motor extending through the aperture in the base part into the output part of the swinging bridge. An eccentric on the drive shaft drives the output part. A frame-like motor support has a transverse U-shape, one end of such support being connected to the stationary base part of the swinging bridge. The support has two longitudinal sections parallel to the motor drive shaft and partially enclosing the motor housing to form motor bearing surfaces, and a transverse section at its other end to support the other end of the motor housing. Two spring-action tongues are connected to the stationary base part of the swinging bridge respectively adjacent the opposite ends of the shaver head. Two catches are respectively provided at the free ends of the tongues for securing the shaver head. Two shaver-head bearing surfaces are provided on the stationary base part of the swinging bridge respectively adjacent the tongues, the catches pressing the shaver head against such latter bearing surfaces. The swinging bridge, the motor support, the tongues, and the shaver-head bearing surfaces are formed from a plastic as a single-piece component.

6 Claims, 2 Drawing Sheets

DRY SHAVER

This is a continuation of application Ser. No. 882,317, filed July 7, 1986, now abandoned.

FIELD OF THE INVENTION

This invention relates to a dry shaver having a shaver head which is placeable on a basic unit, is held in place by two diametrically opposed catches respectively acting in conjunction with the transverse walls of the shaver head and releasable against the action of a spring, and has a longitudinally extending upper blade and a reciprocatorily driven longitudinally extending lower blade acting in conjunction therewith. The lower blade is driven by the output part of a swinging bridge positioned in the basic unit, which output part is itself driven via an eccentric on the drive shaft of an electric motor having an essentially cylindrical motor housing. The electric motor is connected, with the motor housing pointing away from the swinging bridge, to a stationary base part of the latter, whereby the drive shaft of the electric motor extends through an aperture in such base part to the output part of the swinging bridge.

BACKGROUND OF THE INVENTION

In the dry shaver shown in U.S. Pat. No. 4,167,060 there is provided on the face of the electric motor facing the drive shaft, in order to connect the electric motor to the swinging bridge, a connecting plate perpendicular to the drive shaft of the electric motor and supported at its free ends by the base part of the swinging bridge. The connecting plate has a U-shaped bulge on each side of the drive shaft of the electric motor, through which bulges screws pass into and through the base part of the swinging bridge, as a result of which the electric motor is secured to the base part of the swinging bridge in the manner of a clamped connection. Furthermore, the shaver head is secured to the basic unit by two locking catches each adjustable against the action of a spring. Such a dry shaver is relatively expensive as it has a relatively large number of individual components, as a result of which its assembly is also complicated and therefore relatively time-consuming.

SUMMARY OF THE INVENTION

The object of the present invention is to construct a dry shaver of the type described above in such a way that it has as few components as possible and its assembly is as simple as possible so that if applicable such assembly can be fully automated. According to the invention it is provided for this purpose that a U-shaped frame-type support is connected to the base part of the swinging bridge, whereby the longitudinal sections of the support run parallel to the drive shaft of the electric motor and, pointing away from the swinging bridge, project from the base part of the latter, and that the electric motor is inserted in this support, whereby the motor housing is supported at the face facing towards the drive shaft by the base part and at the face facing away from the drive shaft by the transverse section of the support and is enclosed around part of its circumference by both longitudinal sections of the support for forming motor bearing surfaces. It is also provided that the two catches for securing the shaver head are positioned in the vicinity of the corresponding free ends of two spring-action tongues, that the tongues are connected to the base part of the swinging bridge, that on the base part of the swinging bridge there is arranged at least one bearing surface for the shaver head, against which bearing surface the shaver head is held pressed by the two catches, and that the swinging bridge, the support, the tongues and the shaver head bearing surface are manufactured from a plastic as a single-piece component. In this manner a very simple design is achieved since no separate parts are required for mounting and positioning the electric motor or for securing the shaver head, as a result of which assembly is very simple. Moreover, such a single component performing all these functions and including the swinging bridge is very easy to produce from a plastic in only one operation.

It should be mentioned at this point that U.S. Pat. No. 4,240,200 shows a dry shaver in which a vibratory motor and a shaver head are joined by means of a plate to form one constructional unit. The shaver head is secured to the plate that forms a bearing surface for the shaver head by two diametrically opposed catches releasable against the action of a spring, these catches taking the form of hooks in the vicinity of the corresponding free ends of two spring-action tongues, which themselves are connected to the plate and form with it a single-piece component. Moreover, the vibratory motor acting directly in conjunction with the lower blade of the shaver head is attached to the plate by screws. This dry shaver does not therefore have a swinging bridge, with the result that the plate only serves to mount the shaver head and attach the vibratory motor, whereby no measures are taken to ensure that the vibratory motor can be connected to the plate without further means of attachment.

In contrast to this, in the dry shaver according to the present invention a single-piece component is provided, which performs in total three functions viz. mounting and positioning of the electric motor, formation of the swinging bridge and mounting of the shaver head. On the basis of these measures the possible tolerances which can occur between the individual components and can constitute a hindrance during assembly of these components, are reduced to such an extent that problem-free combined operation of the electric motor, the swinging bridge and the shaver head is guaranteed.

It has proven to be advantageous for the U-shaped frame-type support to be supported at its side facing away from the electric motor by the housing of the basic unit. In this manner the mounting of the electric motor is particularly stable since the support itself is supported. It has also proven to be advantageous for the electric motor, at its side facing away from the U-shaped frame-type support, to be subjected to pressure by at least one spring element, which presses such electric motor onto the support. In this way the mounting of the electric motor is very well stabilised, in particular in the case of sudden impact-type pressure. Suitable spring elements are rubber buffers, rubber strips, foam strips and the like, which can be attached for example to the housing of the basic unit.

With regard to the spring-action tongues they can be made resilient and flexible as a whole. However, it has proven to be very advantageous for the tongues themselves to be stiff and to be connected each to the base part of the swinging bridge by two coaxial rods forming torsion springs, each projecting laterally from the end facing away from the free end bearing the catch. Such division into flexible areas and stiff areas of the tongues ensures on the one hand that they are flexible and resilient and on the other hand that they hold the shaver head securely on the base part of the swinging bridge. In this case the entire single-piece component can be manufactured from a plastic giving a relatively high stiffness so that as a whole it is stable and guarantees problem-free mounting of the shaver head and the electric motor, whereby the spring action for the catches is obtained by the dimensioning of the rods.

Moreover, in a dry shaver in which the motor housing of the electric motor has a coaxial attachment to the drive shaft of the electric motor on at least one of its two faces, it has proven to be very advantageous in the vicinity where the motor housing face bearing an attachment is supported by the single-piece component forming the swinging bridge, the support, the tongues and the shaver head bearing surface for there to be provided a groove-shaped recess in the single-piece component into which recess the attachment provided on the face of the motor housing fits. In this way the mounting and the positioning of the electric motor are particularly effective and secure.

BRIEF DESCRIPTION OF THE DRAWINGS

The invention will now be described in further detail with reference to the accompanying drawings, in which.

DETAILED DESCRIPTION OF THE PREFERRED EMBODIMENTS

Figure 1:
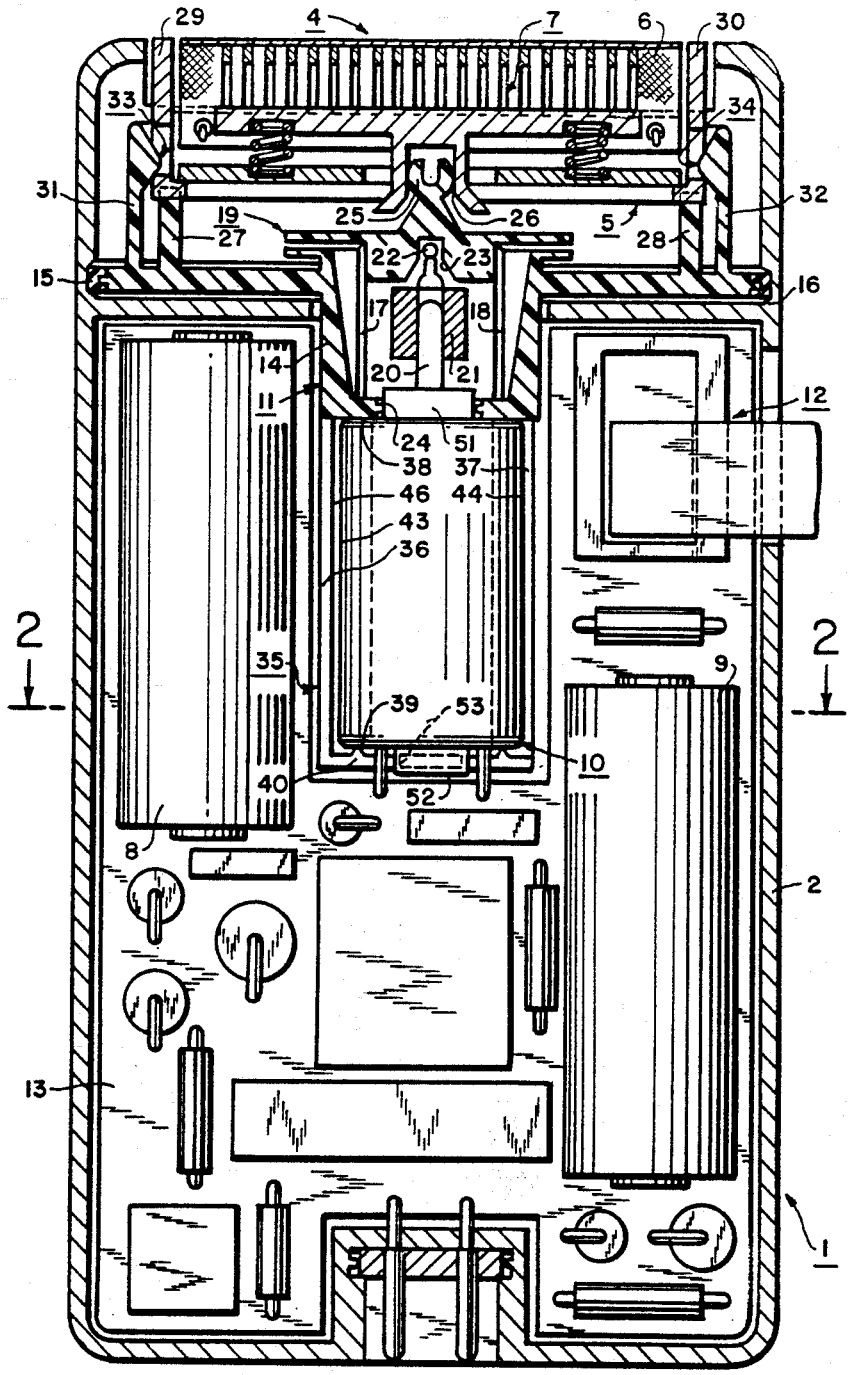
FIG. 1 shows, partly in cross section, a dry shaver in which the swinging bridge, the support for the electric motor, the tongues having catches for securing the shaver head, and the two shaver head bearing surfaces are manufactured as a single-piece component, whereby the tongues as a whole are flexible and resilient.
Figure 2:
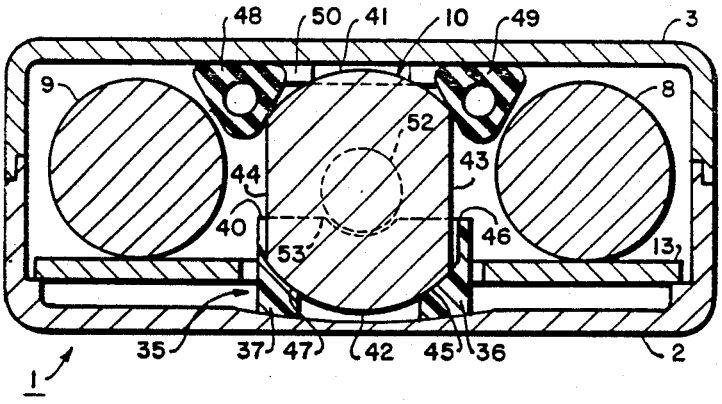
FIG. 2 shows a section taken along the line II—II in FIG. 1.

FIGS. 1 and 2 show a basic unit 1 of a dry shaver, the housing of which is assembled from two housing shells 2 and 3. A shaver head 4 on this basic unit 1, has a shaver head frame 5 supporting a longitudinally extending upper blade 6, with which a longitudinally extending lower blade 7 capable of being reciprocated acts in conjunction. In the present embodiment, the upper blade 6 is designed as a curved perforated shaver foil and the lower blade 7 as a lamellar blade. By way of example however the upper blade and the lower blade could take the form in known manner of trimmer blades working in conjunction. The basic unit 1 contains an electric motor 10, which can be powered for example by batteries 8 and 9, a swinging bridge 11 and further components such as an on/off switch 12, which is located on a PCB 13 together with both batteries 8 and 9 and electrical circuit elements forming a charging connection for the batteries and not shown here in further detail.

The swinging bridge 11 constructed in the customary manner has a stationary base part 14, which is secured between the housing shells 2 and 3, for which purpose its border is adapted to the housing interior and fits by means of a sealing ring 15 into corresponding grooves 16 formed in the housing shells 2 and 3. The output part 19 of the swinging bridge 11, which output part is itself capable of being reciprocated, is connected to this base part 14 via film hinges 17 and 18. The output part 19 is driven by the drive shaft 20 of the electric motor 10 via an eccentric 21 placed on the drive shaft 20, the pin 22 of such eccentric fitting into a slot 23 provided on output part 19. The electric motor 10 having an essentially cylindrical motor housing is connected to the base part 14 of the swinging bridge 11 in such a way that its motor housing points away from the swinging bridge 11, whereby its drive shaft 20 extends through an aperture 24 in the base part 14 into the output part 19 of the swinging bridge 11. Power is transferred from the swinging bridge 11 to the lower blade 7 via a drive arm 25 provided on the output part 19 of the swinging bridge, such drive arm fitting into a forked attachment 26 on the lower blade 7.

The shaver head 4 rests on bearing surfaces 27 and 28 provided on the base part 14 of the swinging bridge 11 and is secured by two diametrically opposed catches 33 and 34 at the corresponding free ends of two tongues 31 and 32, these catches respectively acting in conjunction with the transverse walls 29 and 30 of the shaver head frame 5 of the shaver head 4 and respectively releasable against the action of a spring. In the present embodiment the catches 33 and 34 are formed by hook-like attachments, which fit into corresponding apertures in the transverse walls 29 and 30 of the shaver head frame 5. In mirror-image reversal however it would also be possible for the catches provided at the corresponding free ends of the tongues 29 and 30 to be formed as apertures, into which hooks provided on the transverse walls 29 and 30 of the shaver head frame 5 respectively fit. With regard to the strip-shaped bearing surfaces 27 and 28 for the shaver head 4, alternatively four individual stays could be provided or the base part 14 itself could serve as a bearing surface for the shaver head 4, if the shaver head frame 5 of the latter were to extend right up to this base part 14.

A U-shaped frame-type support 35 comprising longitudinal sections 36 and 37 and transverse section 40 is connected to the base part 14 of the swinging bridge 11, whereby both longitudinally sections 36 and 37 of such support run parallel to the drive shaft 20 of the electric motor 10 and, pointing away from the swinging bridge 11, project from the base part 14 of the latter. The electric motor 10 is inserted into this support 35, whereby its motor housing is supported at the face 38 facing towards the drive shaft 20 by the base part 14 and at the face 39 facing away from the drive shaft 20 by the transverse section 40 of the support 35, and is enclosed around part of its circumference by both longitudinal sections 36 and 37 of the support 35 for forming motor bearing surfaces. Both these motor bearing surfaces are clearly visible in particular in FIG. 2. In the present embodiment the essentially cylindrical motor housing has two arced circumferential sections 41 and 42 and two diametrically opposed segmentally stepped flat side walls 43 and 44 running in the direction of the drive shaft 20, as is often the case with electric motors of this type. Accordingly, the longitudinal section 36 for enclosure of the motor housing around part of its circumference has two connecting sections 45 and 46, of which the section 45 is arced and the section 46 flat, whereby the motor housing is supported at its arced circumferential section 42 by the arced section 45 and rests with its side wall 43 against the flat section 46 of this longitudinal section 36. In the present embodiment the other longitudinal section 37 of the support 35 is designed in such a way that it has only an arced section 47, against which the motor housing is again supported at its arced circumferential section 42. If so desired, this longitudinal section 37 could also have an additional flat section, against which the side wall 44 of the motor housing could then rest. Of course, the provision of such flat sections on the longitudinal sections 36 and 37 is not absolutely necessary but with a motor housing having side walls such as 43 and 44 it offers the advantage of torsion-proof mounting of the electric motor 10. In this manner the U-shaped frame-type support 35 connected to the base part 14 of the swinging bridge 11 forms a secure mounting for the electric motor 10, such mounting also positioning the electric motor properly in relation to the swinging bridge 11.

Also connected to the base part 14 of the swinging bridge 11 are the tongues 31 and 32 bearing the catches 33 and 34, and the shaver head bearing surfaces 27 and 28. Thus the swinging bridge 11 forms together with the support 35, the tongues 31 and 32 and the shaver head bearing surfaces 27 and 28 a single-piece component, which can be manufactured very easily from a plastic. This single-piece component thus performs several functions, viz. the mounting of the electric motor 10, the releasable mounting of the shaver head 4 and the formation of a swinging bridge 11 for converting the rotating drive motion of the electric motor 10 into a reciprocating drive motion for the lower blade 7 of the shaver head 4. In this manner a very simple design of the dry shaver is obtained since no separate parts are required for mounting and positioning of the electric motor 10 or for releasable securing of the shaver head 4, as a result of which assembly of the dry shaver is also very simple. Because of these measures, the possible tolerances which can occur between the individual components and which can constitute a hindrance during assembly of these components are reduced to such an extent that problem-free combined action of electric motor 10, swinging bridge 11 and shaver head 4 is guaranteed.

As can be seen from FIG. 2, the support 35 formed by both the longitudinal sections 36 and 37 and the transverse section 40 has been designed in such a way that it is supported at its side facing away from the electric motor 10 by the housing shell 2 of the basic unit 1. In this manner the mounting of the electric motor 10 is particularly stable, since the support 35 is itself supported. A corresponding profile shape, as visible in FIG. 2, of on the one hand the housing shell 2 and on the other hand both longitudinal sections 36 and 37 and the transverse section 40 ensures the positional stability of the support 35. Moreover, as FIG. 2 also shows, the electric motor 10 is subjected to pressure at its side facing away from the support 35 by two spring elements 48 and 49, which press it onto the support 35. In the present case both these spring elements 48 and 49 are made of rubber strips, which are supported by the housing shell 3 of the basic unit 1. Both rubber strips are joined to form a frame by two bars, of which one bar 50 is visible in FIG. 2, it being possible to place such frame easily on the electric motor 10 during assembly of the dry shaver. Of course it would also be possible to attach both rubber strips to the housing shell 3. In this manner the mounting of the electric motor is very well stabilised by both spring elements 48 and 49, in particular in the case of sudden impact-type pressure. In the present case both rubber strips also space both batteries 8 and 9 from the electric motor 10. Of course it would be possible to construct such spring elements from other materials, such as rubber buffers, foam strips and the like.

In the present embodiment the motor housing of the electric motor 10 has in both its faces 38 and 39 in each case a coaxial attachment 51 and 52 to the drive shaft 20 of the electric motor 10. These attachments 51 and 52 can also be used for mounting and positioning of the electric motor 10. Accordingly the aperture 24 provided in the base part 14, through which the drive shaft 20 of the electric motor 10 extends to the output part 19 of the swinging bridge 11, takes the form of a groove-shaped recess, into which the attachment 51 fits and in the present case is enclosed diametrically. In a similar manner the other attachment 52 fits into a groove-shaped recess 53 in the transverse section 40 of the support 35, as can be seen in particular from FIG. 2. In this manner particularly effective and secure mounting and positioning of the electric motor 10 are achieved.

Figure 3:
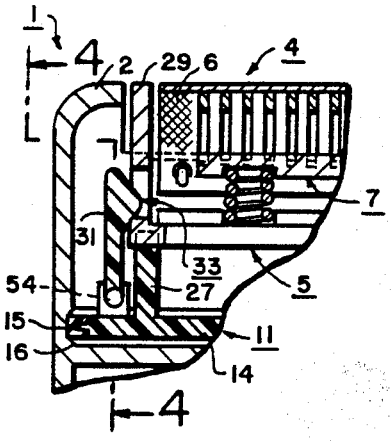
FIG. 3 is a partial detail of a dry shaver, in which the tongues bearing catches for securing the shaver head are stiff and are respectively connected to the base part of the swinging bridge by means of two rods forming torsion springs.
Figure 4:
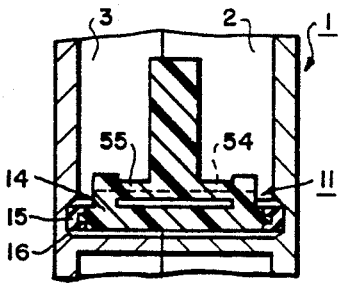
FIG. 4 shows a section taken along the line IV—IV in FIG. 3.

In the above-described embodiment the tongues 31 and 32 bearing the catches 33 and 34 are as a result of their cross-sectional dimensions flexible and resilient, in order to secure the shaver head 4 to the base part 14 of the swinging bridge 11 in a manner which allows such shaver head to be released. In contrast to this, in the embodiment shown in FIGS. 3 and 4 the tongues, of which FIG. 3 shows one tongue 31, are stiff and are each connected to the base part 14 of the swinging bridge 11 via two coaxial rods 54 and 55 forming torsion springs, each rod projecting laterally from the end facing away from the corresponding free end bearing the catch. Such division into flexible areas formed by the rods 54 and 55 and stiff areas formed by the tongues ensures that the tongues together with the catches on the one hand are flexible and resilient and on the other hand attach the shaver head 4 securely to the base part 14 of the swinging bridge 11. In this case the entire single-piece component forming the swinging bridge, the support, the tongues with the catches and the shaver head bearing surfaces can be manufactured from a plastic having a relatively high stiffness, so that as a whole it is stable and guarantees problem-free mounting of the shaver head 4 and the electric motor 10, whereby the spring action for the catches on the tongues is obtained by the dimensioning of the rods 54 and 55.

What is claimed is:

1. A dry shaver comprising a basic unit housing; a shaver head having a longitudinally extending upper blade and a reciprocatorily drivable longitudinally extending lower blade acting in conjunction therewith; a swinging bridge secured in the basic unit housing and having a reciprocatory output part for driving the lower blade and a stationary base part provided with an aperture; an electric motor having an essentially cylindrical housing, one end of the motor housing being connected to the stationary base part of the swinging bridge, the drive shaft of the motor extending through the aperture in such base part into the output part of the swinging bridge; an eccentric on the drive shaft for driving such output part; a frame-like U-shaped motor support, one end of such support being connected to the stationary base part of the swinging bridge; the support having two longitudinal sections parallel to the motor drive shaft and partially enclosing the motor housing to form motor bearing surfaces, and a transverse section at its other end to support the other end of the motor housing; two spring-action tongues connected to the stationary base part of the swinging bridge respectively adjacent the opposite ends of the shaver head; two catches respectively provided at the free ends of the tongues for securing the shaver head; and two shaver-head bearing surfaces on the stationary base part of the swinging bridge respectively adjacent the tongues, the catches pressing the shaver head against such latter bearing surfaces; the swinging bridge, the U-shaped motor support, the tongues, and the shaver-head bearing surfaces being formed from a plastic as a single-piece component.

2. A dry shaver according to claim 1, in which the U-shaped frame-like support comprises a side facing away from the electric motor, said U-shaped frame-like support being supported at its side facing away from the electric motor by the basic unit housing.

3. A dry shaver according to claim 2, wherein the electric motor comprises a side facing away from the U-shaped frame like support and a spring element subjects the electric motor to pressure at said side facing away from the U-shaped frame-like support to press the motor into the support.

4. A dry shaver according to claim 1, in which the tongues are stiff and which includes for each tongue two coaxial rods forming torsion springs respectively projecting laterally from the end of the tongue opposite its free end bearing the catch.

5. A dry shaver according to claim 1, which includes a coaxial attachment to the drive shaft of the electric motor, and in which the aperture in the base part of the swinging bridge is provided with a groove-shaped recess, said coaxial attachment fitting into such recess.

6. A dry shaver comprising a basic unit housing; a shaver head having a longitudinally extending upper blade and a reciprocatorily drivable longitudinally extending lower blade acting in conjunction therewith; a swinging bridge secured in the basic unit housing and having a reciprocatory output part for driving the lower blade and a stationary base part provided with an aperture; an electric motor having an essentially cylindrical housing, one end of the motor housing being connected to the stationary base part of the swinging bridge, the drive shaft of the motor extending through the aperture in such base part into the output part of the swinging bridge; an eccentric on the drive shaft for driving such output part; a frame-like U-shaped motor support, one end of such support being connected to the stationary base part of the swinging bridge; the support having two longitudinal sections parallel to the motor drive shaft and partially enclosing the motor housing to form motor bearing surfaces, a transverse section at its other end to support the other end of the motor housing, and a side facing away from the electric motor supported by the basic unit housing; at least one spring element connected to the basic unit housing and subjecting pressure on a side of the electric motor facing away from the U-shaped frame-like support to press the motor onto said support; two spring-action tongues connected to the stationary base part of the swinging bridge respectively adjacent the opposite ends of the shaver head; two catches respectively provided at the free ends of the tongues for securing the shaver head; and two shaver-head bearing surfaces on the stationary base part of the swinging bridge respectively adjacent the tongues, the catches pressing the shaver head against such latter bearing surfaces; the swinging bridge, the U-shaped frame-like motor support, the tongues, and the shaver-head bearing surfaces being formed from a plastic as a single-piece component.

* * * * *